US011116290B2

(12) United States Patent
Huang et al.

(10) Patent No.: US 11,116,290 B2
(45) Date of Patent: Sep. 14, 2021

(54) CONVENIENT AND QUICK-RELEASE TEXTILE

(71) Applicant: KEE (GUANGDONG) GARMENT ACCESSORIES LTD., Guangdong (CN)

(72) Inventors: Shengchang Huang, Guangdong (CN); Jerry Wang, Guangdong (CN)

(73) Assignee: KEE (GUANGDONG) GARMENT ACCESSORIES LTD., Guangdong (CN)

( * ) Notice: Subject to any disclaimer, the term of this patent is extended or adjusted under 35 U.S.C. 154(b) by 0 days.

(21) Appl. No.: 14/370,827

(22) PCT Filed: Mar. 29, 2013

(86) PCT No.: PCT/CN2013/073488
§ 371 (c)(1),
(2) Date: Jul. 7, 2014

(87) PCT Pub. No.: WO2014/146311
PCT Pub. Date: Sep. 25, 2014

(65) Prior Publication Data

US 2016/0242515 A1 Aug. 25, 2016

(30) Foreign Application Priority Data

Mar. 22, 2013 (CN) ..... 201310094177.8

(51) Int. Cl.
*A44B 19/24* (2006.01)
*A44B 19/04* (2006.01)
(Continued)

(52) U.S. Cl.
CPC ..... *A44B 19/24* (2013.01); *A44B 19/02* (2013.01); *A44B 19/04* (2013.01); *A44B 19/262* (2013.01); *A44B 19/38* (2013.01); *A44B 19/384* (2013.01)

(58) Field of Classification Search
CPC ..... A44B 19/02; A44B 19/04; A44B 19/24; A44B 19/262; A44B 19/38; A44B 19/384
See application file for complete search history.

(56) References Cited

U.S. PATENT DOCUMENTS 4,397,378 A * 8/1983 Lee ..... A45C 3/001 190/119
2009/0222968 A1* 9/2009 Pisano-Ginter ..... A41B 13/005 2/80

(Continued)

*Primary Examiner* — David M Upchurch

(57) ABSTRACT

A convenient and quick-release textile, a quick-release slide fastener being provided on the textile includes: a tooth easy-release region being provided on the teeth of the quick-release slide fastener. A pulling member is provided beside the tooth easy-release region. Quick positioners having a mutual positioning function are further provided on both the textile and the pulling member correspondingly. The quick positioner provided on the textile and the quick positioner provided on the pulling member are located on a same side of the quick-release slide fastener, or separately on two sides of the quick-release slide fastener. In this way, the pulling member textile is held easily and covers the tooth easy-release region, thus preventing the tooth easy-release region from separating due to the impact of the unnecessary external force.

11 Claims, 4 Drawing Sheets

(51) Int. Cl.

| | |
|---|---|
| ***A44B 19/38*** | (2006.01) |
| ***A44B 19/02*** | (2006.01) |
| ***A44B 19/26*** | (2006.01) |

(56) References Cited

U.S. PATENT DOCUMENTS

| | | | | |
|---|---|---|---|---|
| 2010/0269312 | A1* | 10/2010 | Wagner | A44B 18/0088 24/400 |
| 2012/0011684 | A1* | 1/2012 | Takasawa | A44B 19/06 24/406 |
| 2013/0185841 | A1* | 7/2013 | Berkowitz | A41D 13/00 2/69 |
| 2013/0283498 | A1* | 10/2013 | Hewitt | A63B 71/141 2/161.1 |

* cited by examiner

CONVENIENT AND QUICK-RELEASE TEXTILE

FIELD OF THE INVENTION

The present invention relates to a textile capable of being quickly released by a slide fastener.

BACKGROUND OF THE INVENTION

As one of the top ten most practical inventions of this century to humans, slide fasteners have been widely applied to textiles, and further developed into slide fastener structures with various functions due to the diversified purposes thereof. An easy-release slide fastener, as one of them, after provided on textiles such as trousers, clothes or bedding bags, can be fast unzipped from the middle part of the slide fastener, without pulling the puller, thus achieving the quick release of the textiles. Teeth of such a quick-release slide fastener generally include a tooth easy-release region. The teeth within the tooth easy-release region will not be separated from each other easily during normal use. However, the teeth of the slide fastener, when the textiles on two sides of the tooth easy-release region are pulled hard, can be fast separated from each other starting from the tooth easy-release region, thus achieving the quick release.

In the prior art, for textiles using a quick-release slide fastener, the textiles themselves on the two sides of the quick-release slide fastener are used directly as pulling portions. In this case, the release operation is often difficult somewhat due to the lack of focus, thus greatly reducing the effectiveness of quick removal of sweatpants. Moreover, the textiles may become dirty easily. Therefore, how to provide an efficient quick-release function to the quick-release slide fastener becomes a research topic to which this industry must pay attention.

SUMMARY OF THE INVENTION

An object of the present invention not only is to provide an additional device on the textile to assist in unzipping the quick-release slide fastener thus to improve the quick-release efficiency, and also assist in preventing the tooth easy-release region of the quick-release slide fastener from separating easily during normal use of the textile.

In order to solve the technical problem described above, the present invention provides a convenient and quick-release textile, a quick-release slide fastener being provided on the textile, a tooth easy-release region being provided on the teeth of the quick-release slide fastener, wherein a pulling member is provided beside the tooth easy-release region.

According to the technical solution mentioned above, a user, when directly pulling the pulling member by a hand, may apply a pulling force to the slide fastener beside the pulling member, thus to enable the teeth in the tooth easy-release region of the slide fastener to separate from each other. In this way, the pulling member can be held by the user easily, and is also simple to operate. Moreover, the hand just needs to hold the pulling member only instead of holding the textile directly. For example, for servicemen or chefs, their greasy hands do not need to pull the textiles such as clothes or trousers directly. The pulling member may be provided on a slide fastener cloth strap beside the tooth easy-release region, or on the textile beside the tooth easy-release region. Further, the pulling member may be a strip of cloth or small hardware with a certain width. Furthermore, an annular portion may be provided on the pulling member. The annular portion may be hooked by a finger, or the structure strength of the pulling member is improved by the annular portion.

It is obviously ugly if the pulling member freely waggles on the textile, and the pulling member is likely to be dirtied or damaged. Moreover, it is very inconvenient in some occasions. For this reason, as a further technical solution, quick positioners having a mutual positioning function are further provided on both the textile and the pulling member correspondingly. In this way, the pulling member may be fixed on the textile in a lying manner through the quick positioners.

As a further technical solution, the quick positioner provided on the textile and the quick positioner provided on the pulling member are located on a same side of the quick-release slide fastener, or separately on two sides of the quick-release slide fastener.

Locating the quick positioner provided on the textile and the quick positioner provided on the pulling member on a same side of the quick-release slide fastener can position the pulling member in a lying manner.

When the quick positioner provided on the textile and the quick positioner provided on the pulling member are separately located on the two sides of the quick-release slide fastener, the pulling member is actually made across the slide fastener from one side of the slide fastener, then extended to the other side of the slide fastener, and finally positioned on the other side in a lying manner. Due to poor connection performance of the teeth in the tooth easy-release region of the slide fastener, the connection performance will be further degraded after used and worn for many times. In this way, the pulling member can cover the tooth easy-release region of the slide fastener, thus preventing the tooth easy-release region of the slide fastener from separating due to the impact of unnecessary external force. Moreover, the structure strength of the tooth easy-release region is improved in the aid of the pulling member and the quick positioners, thus enabling the tooth easy-release region of the slide fastener to separate not so easily even under the impact of unnecessary external force. The quick positioners having a mutual positioning function may be buttons (also referred to as snap fasteners) or magic tapes (commonly referred to as Velcro tapes).

Due to the characteristics and advantages described above, the present invention may be applied to quick-release textiles.

DETAILED DESCRIPTION OF THE PREFERRED EMBODIMENTS

Figure 1:
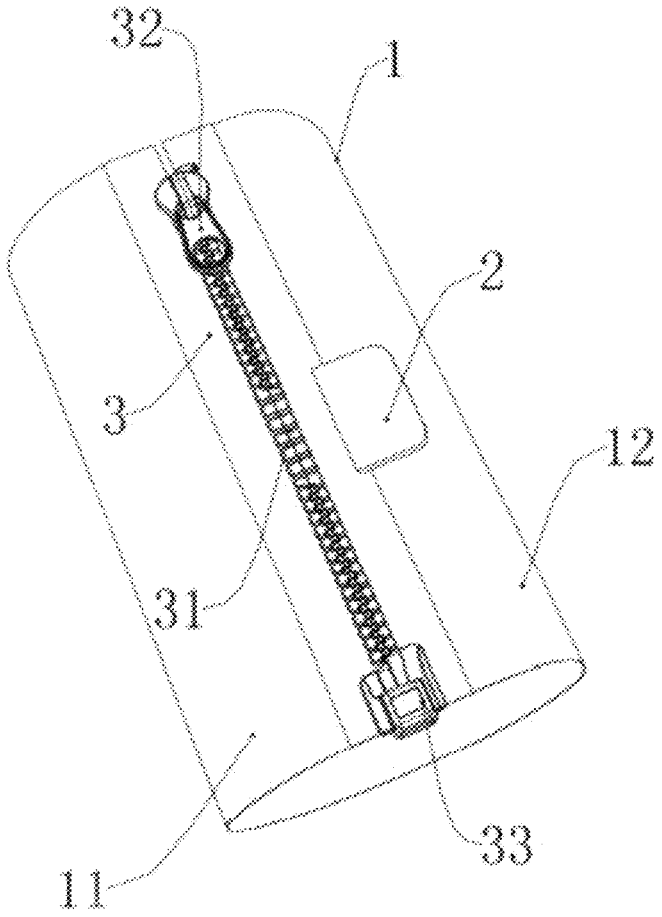
FIG. 1 is a stereoscopic structure diagram of a convenient and quick-release textile according to the present invention.

A quick-release textile as illustrated in FIG. 1 is a trouser leg portion of quick-release trousers, including a quick-release slide fastener 3 sewn on the trouser leg 1. Two sides of the quick-release slide fastener 3 are respectively a left side 11 and a right side 12 of the trouser leg 1. A quick-release upper stop structure member (covered by a puller 32) and a lower stop structure member 33 are separately provided at the two ends of the quick-release slide fastener 3; besides, a tooth portion in the middle of the quick-release slide fastener 3 is a tooth easy-release region 31; and a pulling member 2 is sewn on the textile beside the tooth easy-release region 31. The pulling member 2 is a strip of cloth of double-layer structure and is thus annular. Of course, a ring made of flexible metal wire may also be used as the pulling member.

During use, by first combining the lower stop structure member 33 of the quick-release slide fastener 3 and then pulling upward via the puller 32 to the upper stop structure member, the quick-release slide fastener 3 may be completely closed to form a cylindrical trouser leg 1.

Figure 2:
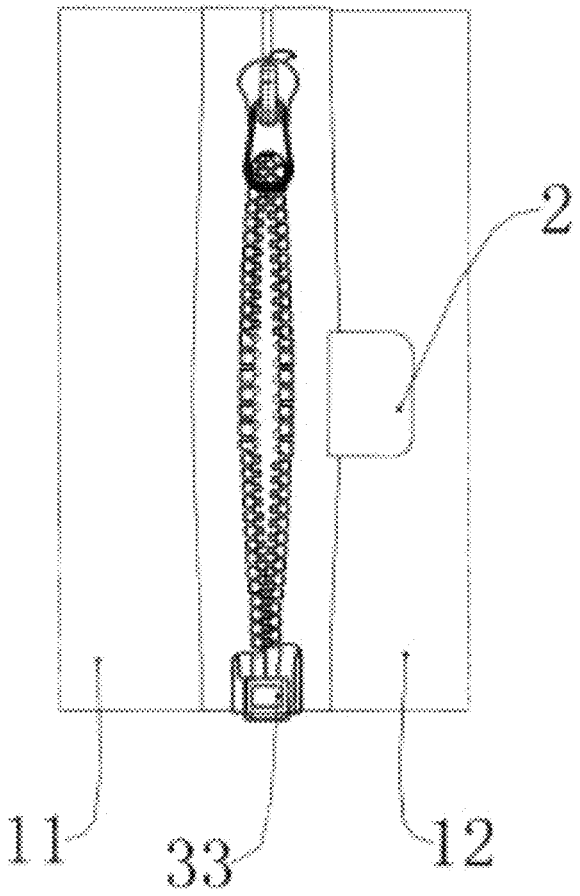
FIG. 2 is a first operating diagram of the convenient and quick-release textile according to the present invention.
Figure 3:
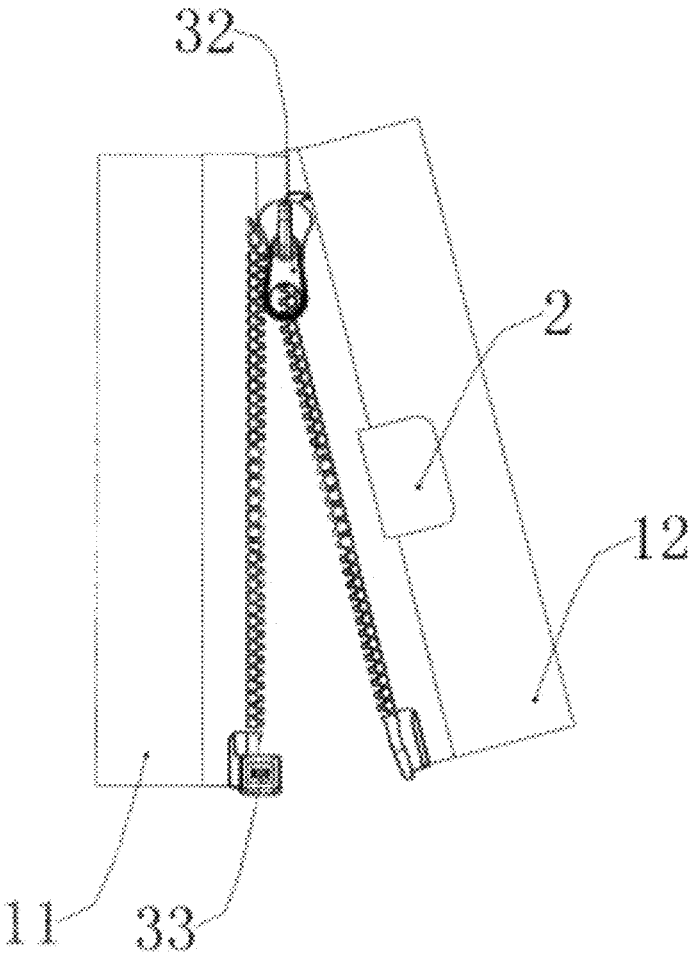
FIG. 3 is a second operating diagram of the convenient and quick-release textile according to the present invention.

As illustrated in FIG. 2, a user, when intended to quickly remove the trousers having the quick-release slide fastener 3, may hold and drag the pulling member 2 outward, so that the teeth within the tooth easy-release region 31 beside the pulling member 2 automatically separate from each other. Subsequently, all the teeth of the slide fastener 3 are separated due to the shearing action, so that the trouser leg 1 is opened completely. Even, the upper stop structure member and the lower stop structure member 33 at the two ends of the slide fastener are also separated, respectively, as illustrated in FIG. 3, so that the trouser leg 1 becomes unclosed quickly. Therefore, once both trouser legs 1 of the trousers become unclosed, the trousers may be quickly removed.

Figure 4:
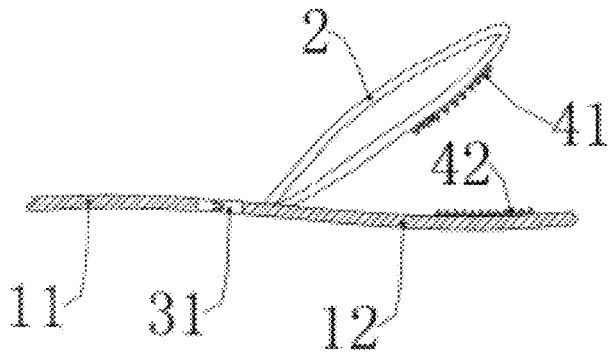
FIG. 4 is a first structure diagram of a quick positioner provided on a pulling member on the convenient and quick-release textile according to the present invention.

Further, as illustrated in FIG. 4, quick positioners (41, 42) having a mutual positioning function are provided on both the pulling member 2 and the textile adapted to the pulling member 2, and the quick positioners (41, 42) are magic tapes. The quick positioners (41, 42) having a mutual positioning function are located on a same side of the slide fastener 3. In this way, the pulling member 2 may be fixed on the trouser leg 1 in a lying manner through the quick positioners (41, 42), thus preventing the pulling member 2 from waggling on the trouser leg 1.

Figure 5:
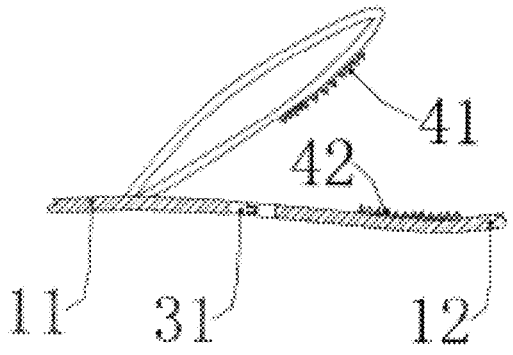
FIG. 5 is a second structure diagram of the quick positioner provided on the pulling member on the convenient and quick-release textile according to the present invention.

As a further solution as illustrated in FIG. 5, the quick positioners (41, 42) having a mutual positioning function are separately provided on two sides of the slide fastener 3, i.e., on the left side 11 and the right side 12. The quick positioner 41 is provided on the pulling member 2 while the quick positioner 42 is provided on the textile (and the right side 12) opposite to the pulling member 2. After the pulling member 2 is positioned, the pulling member 2 is actually made across the slide fastener 3 from one side of the slide fastener, then extended to the other side of the slide fastener 3, and then fixed on the trouser leg 1 in a lying manner. The pulling member 2 is covered over the tooth easy-release region 31. In this way, during normal use of the trouser leg 1, the tooth easy-release region 31 may be covered by the pulling member 2, so that the tooth easy-release region 31 is kept away from any unnecessary external force. Moreover, the structure strength of the tooth easy-release region 31 may be improved by the pulling member 2, so that the tooth easy-release region is unlikely to separate easily even under the impact of unnecessary external force. The quick positioners (41, 42) having a mutual positioning function may also be buttons.

What is claimed is:

1. A convenient and quick-release textile, comprising:

a quick-release slide fastener having a plurality of teeth; and a pulling member;

wherein the quick-release slide fastener defines two opposite sides with the teeth of the quick-release slide fastener in between; and the two opposite sides extend along a length direction of the quick-release slide fastener;

the teeth of the quick-release slide fastener comprise a tooth easy-release region;

the pulling member is fixed at its one end to one of the two opposite sides beside the tooth easy-release region, and the pulling member is capable of being held and pulled outward such that teeth of the tooth easy-release region separate from each other to release the quick-release slide fastener.

2. The convenient and quick-release textile of claim 1, wherein the pulling member is provided at the other end with a quick positioner, and a mating quick positioner is provided on the textile to engage with the quick positioner.

3. The convenient and quick-release textile of claim 2, wherein the mating quick positioner on the textile and a fixed end of the pulling member are located on the same side relative to the length direction of the quick-release slide fastener; and the pulling member is positioned when the quick positioner is engaged with the mating quick positioner without covering the tooth easy-release region.

4. The convenient and quick-release textile of claim 2, wherein the mating quick positioner on the textile and a fixed end of the pulling member are located on the two opposite sides, respectively relative to the length direction of the quick-release slide fastener; and the pulling member is positioned when the quick positioner is engaged with the mating quick positioner to cover the tooth easy-release region.

5. The convenient and quick-release textile of claim 2, wherein the quick positioner and the mating quick positioner are snap fasteners or hoop and loop fasteners.

6. The convenient and quick-release textile of claim 1, wherein the pulling member comprises an annular portion.

7. The convenient and quick-release textile of claim 1, wherein the pulling member is a strip of cloth.

8. The convenient and quick-release textile of claim 1, wherein the pulling member is a flexible metal wire.

9. The convenient and quick-release textile of claim 1, wherein, when the teeth of the tooth easy-release region separate from each other, all the teeth of the quick-release slide fastener are separated due to shearing action.

10. The convenient and quick-release textile of claim 1, wherein the quick-release slide fastener further comprises an upper stop member and a lower stop member.

11. The convenient and quick-release textile of claim 10, wherein, when the teeth of the tooth easy-release region separate from each other, all the teeth of the quick-release slide fastener are separated due to shearing action, and the upper stop member and the lower stop member are separated, respectively.

* * * * *